United States Patent [19]

Russell et al.

[11] Patent Number: 4,878,920

[45] Date of Patent: Nov. 7, 1989

[54] PROCESS FOR THE CONTINUOUS DYEING OF INDUSTRIAL NYLON

[75] Inventors: Ernest J. Russell, Greensboro; Tanya E. FitzGerald, Fuquay-Varina, both of N.C.

[73] Assignee: Burlington Industries, Inc.

[21] Appl. No.: 43,360

[22] Filed: Apr. 28, 1987

[51] Int. Cl.[4] ..... D06P 00/00

[52] U.S. Cl. ..... 8/476; 8/924

[58] Field of Search ..... 8/476, 924

[56] References Cited

U.S. PATENT DOCUMENTS

| | | | |
|---|---|---|---|
| 2,474,890 | 12/1945 | Croft | 8/55 |
| 2,888,313 | 5/1959 | Mautner | 8/54 |
| 3,253,875 | 5/1966 | Baumann | 8/15 |
| 3,433,008 | 3/1969 | Gage . | |
| 3,503,698 | 3/1970 | Zurbuchen et al. . | |

FOREIGN PATENT DOCUMENTS

| | | |
|---|---|---|
| 100383 | 8/1975 | Japan . |
| 168195 | 9/1984 | Japan . |

OTHER PUBLICATIONS

Bauerle, "Dye Fixation with Superheated Steam", Ciba Geigy Review, No. 4, pp. 27–37 (1973).

"The Theory of Coloration of Textiles", Dyers Company Publications Trust, 1975.

Textile Horizons, 1984, 4, No. 8, Aug., p. 12.

*Primary Examiner*—John F. Niebling

*Assistant Examiner*—Isabelle Rodriguez

*Attorney, Agent, or Firm*—Nixon & Vanderhye

[57] ABSTRACT

Described is a process for continuously dyeing high tenacity nylon 6,6 fabrics including the sequential steps of applying to a high tenacity, highly crystalline nylon 6,6 fabric whose fibers have a breaking tenacity in the range of 6.0 to 10 g/denier and an aqueous dyebath containing a tinctorial amount of at least one dye. The dyed fabric is then steamed with superheated steam at atmospheric pressure and at temperatures greater than 100° C., e.g., 100° to 160° C., for a time sufficient to fix the dye to the fabric, usually up to 3 minutes. Following steaming, the dyed fabric is washed to remove any unfixed dye, then dried.

10 Claims, No Drawings

PROCESS FOR THE CONTINUOUS DYEING OF INDUSTRIAL NYLON

Industrial weight, high-tenacity nylon 6,6 fabrics are continuously and rapidly dyed using superheated steam operating at atmospheric pressure to produce uniformly colored textiles with good color yield by the process of this invention.

Industrial weight, high-tenacity nylon 6,6 fabrics present a uniquely difficult and challenging substrate to dye continuously. The present invention is directed to the dyeing of high-tenacity yarn which is spun from poly(hexamethylene adipamide), also known as nylon 6,6 having a draw ratio in the range of about 4.6 to about 5.1. Two types of nylon 6,6 fall within this general definition. The high-tenacity nylon 6,6 of primary concern in the present application contains about twice as many amino end-groups as the ordinary nylon 6,6 product. This fact promotes undesirable ring dyeing of the high-tenacity nylon and makes uniform dyeing and complete penetration difficult especially on the continuous process basis. Antiballistic nylons and other high-tenacity nylon products may not contain the unique and unusually high content of amino end-groups, but they are equally easily dyed effectively by the process of the present invention. These two types of high-tenacity nylon are further distinguished from ordinary nylon by their high degree of structural order. The high degree of order permits drastic, superheated steaming with little loss of strength of the final product. These and other types of high-tenacity nylon 6,6 fibers are described in U.S. Pat. No. 3,433,008, the disclosure of which is incorporated by reference.

Table I is a comparison of the properties of the usual nylon 6,6 with high-tenacity nylon 6,6 of the type described in U.S. Pat. No. 3,433,008.

TABLE I

COMPARISON OF ORDINARY NYLON 66 WITH HIGH-TENACITY NYLON

| Property | Ordinary Nylon 66 | High-Tenacity Nylon 66 |
|---|---|---|
| Amine End-Groups, m-eq./kg* | 35 to 40 | 75 to 80 |
| Crystallite Orientation relative units | 100 | 200 to 300 |
| Draw Ratio | 3 to 4 | 4 to 5 |
| $T_g$**, °C. | −5 to 1 | higher |
| Breaking Tenacity, g/denier | | |
| Dry | 2.5 to 6.0 | 5.9 to 9.8 |
| Wet | 2.0 to 5.5 | 5.1 to 8.0 |
| Ultimate Elongation, % | | |
| Dry | 25 to 65 | 15 to 28 |
| Wet | 30 to 70 | 18 to 32 |
| Elastic Recovery, %*** | 88 | 89 |

*Milliequivalents/kilogram
**Second-order transition temperature
***Recovery of length from 3% extension Industrial-weight nylon 6,6 fabrics have previously been dyed by exhaust or semi-continuous pad-roll methods. These methods involve the labor-intensive operation of jig dyeing from an aqueous exhaust bath or an 8–12 hour heated fabric roll arrangement which must then see further processing. Both of these dyeing methods are very slow. It is a recognized fact that highly oriented nylon fibers, such as the high-tenacity nylon 6,6 used in this invention, exhibit increased dyeing times. See "The Theory of Coloration of Textiles", edited by C. L. Bird and W. S. Boston, published by the Dyers Company Publications Trust, 1975.

Control of uniformity of coloration from side-to-center-to-side is a constant problem, which to this date has not been adequately addressed. Lack of uniformity creates potentially unacceptable dyed goods, as well as poor width controls when tension is applied to the goods during roll transfers in the jig method. The requirement for the use of tension in jig dyeing is in part responsible for the poor side-to-center-to-side color control, due to uneven build up of the selvages and middle sections during processing.

In addition, both of these conventional procedures present operational difficulties, for instance the inability to handle a wide cross-section of substrate construction due to prolonged batching at elevated temperatures. Certain surface structures and seam formation generally cause moirè appearance and seam bars in goods dyed by roll batching.

The present invention provides an efficient, rapid and continuous process for dyeing industrial weight nylon fabrics, particularly high tenacity nylon 6,6, as described in more detail below. This process is not restricted to specific lot sizes or fabric constructions, and would not be subject to nonuniformity of coloration, both of which are constraints on the present batch processes. A high temperature steam fixation using superheated steam provides an improved means of coloration with acceptable fastness without exposing substrates to high temperature dry heat or prolonged steaming.

DETAILED DESCRIPTION OF THE INVENTION

The process of the present invention provides a means to continuously, rapidly, and uniformly dye industrial weight, high-tenacity nylon 6,6 and features the use of superheated steam which operates at atmospheric pressure and at temperatures above 100° C. Superheated steam is to be distinguished from saturated steam which is no higher in temperature than 100° C. measured at atmospheric pressure. The equipment for employing superheated steam is designed to operate at atmospheric pressure, and thus does not require elaborate and difficult-to-maintain seals and pressure control devices. This means that the equipment cost is inherently lower than continuous pressure steamers, and as a practical matter is less subject to equipment problems and failures.

The process of the present invention provides a number of additional advantages for the coloration of industrial weight high-tenacity nylon 6,6 fabrics. As far as we are aware, it provides for the first time a true continuous process capable of practice on an industrial scale for polyamide fabrics, the constituent yarns of which have a breaking tenacity from 6.0 to about 10 grams per denier. It is much less labor intensive from the batching/rehandling viewpoint and is capable of being practiced on existing range dyeing equipment. Nylon fabrics so dyed are uniform in coloration, free from side-to-center-to-side shading and from moirè and can be dyed at a fairly rapid rate, for instance speeds in excess of 60 yards per minute are expected. Moreover, lot-to-lot repeatability is improved for more convenient continuous operations.

Described is a process for continuously dyeing high-tenacity nylon 6,6 fabrics, as defined above, which includes the operational steps of applying an aqueous dyebath, preferably at an elevated temperature, to the fabric to be dyed. The dyebath contains a tinctorial amount of at least one dye, typically an acid dye which may be any of the known types of dyes commonly used for such fabric. Preferably the aqueous dyebath is applied at elevated temperatures, for instance in a range of about 65° to about 95° C. prior to steaming. It may be desirable, in some cases, to dry the wet fabric to temporarily prevent excessive dye migration. If used, the drying step is conducted preferably in a range of 120°–150° C. The dyed fabric is then subjected to superheated steam at atmospheric pressure and at temperatures greater than 100° C., usually within 3 minutes and often in the range of up to 160° C. for a time sufficient to fix the dye to the fabric. Typical heating times and temperatures are for up to two minutes, preferably from 30–90 seconds, and at a temperature greater than 100° C., for instance about 150° C. Continuously-dyed polyamide fabrics, notably nylon 6,6, in which the constituent yarns have a breaking tenacity between 6 and 10 grams per denier result.

The invention will be further described with reference to the following non-limiting example.

EXAMPLE

Cordura or Antiballistic Nylon fabrics were padded to approximately 35% wet pick-up in an aqueous bath adjusted to pH 3.5 and containing the following acid dyes:

2.80% Telon Yellow KRNL 200% (Acid Yellow 230)

0.92% Telon Red GRL (Acid Red 392)

2.00% Telon Fast Blue A3GL (Acid Blue 290)

1.36% Telon Blue 4GL (Acid Blue)

The padded fabric was then exposed, without intermediate drying, to the steaming conditions specified in Tables II and III.

The Table II shows the results of color measurements on Cordura® fabrics dyed under various steaming conditions. The depth of shade is indicated by the Integrated Depth Value.

As shown by Table II, a time of 2.5 minutes was adequate to develop satisfactory depth of shade. The difference in shade with time of steaming was less at 150° C. than at the other temperatures tested. Examination of the dyed samples showed that all of them were uniform in appearance. Equally satisfactory results were obtained with other acid dyes, such as Acid Blue 25.

Table III shows corresponding results for fabrics containing Type 728 Antiballistic Nylon, 1050 denier/175 filaments. For this material as well, a steaming time of 2.5 minutes was adequate to develop satisfactory depth of shade. Satisfactory shade development could be obtained at a temperature as low as 120° C., but the difference of shade with time of steaming was minimal at 140° C. All of the dyed samples were uniform in appearance.

TABLE II

EFFECTS OF PROCESSING CONDITIONS ON THE DEPTH OF SHADE OF DYED CORDURA ® NYLON FABRICS

| Sample No. | Steaming Time min. | Steaming Temp. °C. | Moisture Content of Oven* g/m | Integrated Depth Value** |
|---|---|---|---|---|
| 1a | 1.0 | 120 | 546 | 26.8 |
| 2a | 2.5 | 120 | 546 | 37.2 |
| 3a | 5.0 | 120 | 546 | 42.9 |

TABLE II-continued

EFFECTS OF PROCESSING CONDITIONS ON THE DEPTH OF SHADE OF DYED CORDURA ® NYLON FABRICS

| Sample No. | Steaming Time min. | Steaming Temp. °C. | Moisture Content of Oven* g/m | Integrated Depth Value** |
|---|---|---|---|---|
| 1b | 1.0 | 140 | 514 | 26.1 |
| 2b | 2.5 | 140 | 514 | 34.1 |
| 3b | 5.0 | 140 | 514 | 31.8 |
| 1c | 1.0 | 150 | 500 | 23.2 |
| 2c | 2.5 | 150 | 500 | 26.3 |
| 3c | 5.0 | 150 | 500 | 27.1 |
| 1d | 1.0 | 160 | 457 | 20.8 |
| 2d | 2.5 | 160 | 457 | 24.3 |
| 3d | 5.0 | 160 | 457 | 25.5 |

*Moisture contents taken from psychrometric chart.

**Integrated Depth Value is a quantitative measure of depth of shade. The definition of Integrated Depth Value and means for its measurement are presented in Besnoy, Textile Chemist and Colorist, Volume 14, No. 5, page 34 (1982).

TABLE III

EFFECTS OF PROCESSING CONDITIONS ON THE DEPTH OF SHADE OF DYED ANTIBALLISTIC NYLON FABRICS

| Sample No. | Steaming Time min. | Steaming Temp. °C. | Moisture Content of Oven* g/m | Integrated Depth Value** |
|---|---|---|---|---|
| 1a | 1.0 | 120 | 546 | 15.0 |
| 2a | 2.5 | 120 | 546 | 20.6 |
| 3a | 5.0 | 120 | 546 | 23.7 |
| 1b | 1.0 | 140 | 514 | 13.5 |
| 2b | 2.5 | 140 | 514 | 17.5 |
| 3b | 5.0 | 140 | 514 | 18.6 |
| 1c | 1.0 | 150 | 500 | 11.8 |
| 2c | 2.5 | 150 | 500 | 14.9 |
| 3c | 5.0 | 150 | 500 | 16.6 |
| 1d | 1.0 | 160 | 457 | 10.2 |
| 2d | 2.5 | 160 | 457 | 14.2 |
| 3d | 5.0 | 160 | 457 | 16.3 |

*Moisture contents taken from psychrometric chart.

**Integrated Depth Value is a quantitative measure of depth of shade. The definition of Integrated Depth Value and means for its measurement are presented in Besnoy, Textile Chemist and Colorist, Volume 14, No. 5, page 34 (1982).

What is claimed:

1. A continuous process for uniformly dyeing high tenacity nylon 6,6 fabrics comprising the sequential steps of:

(a) continuously applying to a high tenacity, highly crystalline nylon 6,6 fabric whose fibers have a breaking tenacity in the range of about 6.0 to about 9.8 g/denier, an aqueous dyebath containing a tinctorial amount of at least one dye the dyebath applied at a temperature of from about 65° C. to about 95° C.;

(b) subjecting the dyed fabric to superheated steam at atmospheric pressure and at a temperatures greater than 100° C. up to 160° C. for a period of time up to 3 minutes sufficient to fix the dye to the fabric; and (c) washing the dyed fabric to remove any unfixed dye and drying the dyed fabric.

2. The process of claim 1 in which intermediate steps (a) and (b) the fabric is dried prior to steaming to temporarily fix the dye and prevent excessive dye migration.

3. The process of claims 1 or 2 in which the nylon 6,6 fibers have at least 50 milliequivalents of amine end-groups per kilogram.

4. The process of claim 1 or 2 in which the crystallite orientation is at least 150 relative units, as compared with ordinary nylon at 100 relative units.

5. The process of claim 1 or 2 in which an acid dye is applied to the fabric.

6. The process of claim 2 in which the fabric is dried at a temperature of about 120° C. to about 150° C.

7. The process of claim 1 or 2 in which the fabric is steamed in step (b) for from about 30 to about 90 seconds.

8. Continuously-dyed nylon 6,6 produced by the process of claim 1.

9. A continuously-dyed polyamide fabric, the constituent yarns of which have a breaking tenacity between 6 h/denier and about 10 g/denier produced by the process of claim 1.

10. A continuously-dyed fabric in which the constituent yarns are highly crystalline nylon 6,6 which have a breaking tenacity between 6 g/denier and about 10 g/denier produced by the process of claim 1.

* * * * *